US006405627B1

(12) United States Patent
Anderson

(10) Patent No.: US 6,405,627 B1
(45) Date of Patent: Jun. 18, 2002

(54) SIMPLE KIT AND METHOD FOR HUMANITARIAN DEMINING OPERATIONS AND EXPLOSIVE ORDINANCE DISPOSAL

(75) Inventor: C. John Anderson, Kingston (CA)

(73) Assignee: Mining Resource Engineering Limited, Kingston (CA)

( * ) Notice: Subject to any disclaimer, the term of this patent is extended or adjusted under 35 U.S.C. 154(b) by 0 days.

(21) Appl. No.: 09/519,748

(22) Filed: Mar. 6, 2000

(30) Foreign Application Priority Data

Mar. 8, 1999 (CA) ..... 2265030
Nov. 5, 1999 (CA) ..... 2288515

(51) Int. Cl.[7] ..... F42B 3/00
(52) U.S. Cl. ..... 89/1.13; 102/402; 102/403
(58) Field of Search ..... 89/1.13; 102/402, 102/403, 315, 317, 324

(56) References Cited

U.S. PATENT DOCUMENTS 3,548,957 A * 12/1970 Schegolevsky
3,580,171 A * 5/1971 Maes
3,687,076 A * 8/1972 Friant et al.
3,719,144 A * 3/1973 Tlam
3,797,392 A * 3/1974 Eckels
3,832,950 A * 9/1974 Hurst
3,926,119 A * 12/1975 Hurst et al.
3,977,921 A * 8/1976 Chandler
3,980,510 A * 9/1976 Ridgeway
4,006,687 A * 2/1977 Ridgeway
4,152,987 A * 5/1979 Lundstrom et al.
4,763,576 A * 8/1988 Kass et al.
4,800,597 A 1/1989 Healey
4,920,852 A * 5/1990 Miller
5,419,257 A * 5/1995 Leichter et al.
5,551,102 A 9/1996 Stewart et al.
5,686,691 A * 11/1997 Hamilton et al.
5,811,726 A * 9/1998 Brown et al.
5,936,194 A * 8/1999 Marlow et al.
5,970,841 A * 10/1999 Trocino
6,007,648 A * 12/1999 Sullivan, Jr. et al.
6,112,633 A * 9/2000 Trocino

FOREIGN PATENT DOCUMENTS

EP 0 178 091 4/1986

* cited by examiner

*Primary Examiner*—Charles T. Jordan
*Assistant Examiner*—Troy Chambers
(74) *Attorney, Agent, or Firm*—Harold C. Baker; Robert A. Wilkes; Robert G. Hendry

(57) ABSTRACT

A kit for humanitarian demining operations and explosive ordnance disposal comprising a first sealed container holding a pre-measured amount of flammable nitroparaffin, and a second sealed container which can be opened and resealed, and which contains a product for sensitizing nitroparaffin to detonation using an initiation system. The second sealed container has a volume sufficient to contain both the pre-measured amount of flammable nitroparaffin and the product for sensitizing nitroparaffin to detonation. The kit may also contain an initiation system. Also disclosed is a method of using the kit to neutralize land-mines and unexploded ordnance.

16 Claims, 5 Drawing Sheets

SIMPLE KIT AND METHOD FOR HUMANITARIAN DEMINING OPERATIONS AND EXPLOSIVE ORDINANCE DISPOSAL

FIELD OF THE INVENTION

This invention relates to explosives and in particular to an explosive kit for use in humanitarian demining operations and explosive ordnance disposal of unexploded ordnance, such as rocket propelled grenades and mortar rounds. In another aspect, this invention relates to a method of explosive neutralization of land mines and other unexploded ordnance.

BACKGROUND OF THE INVENTION

It has been estimated that there are over 110 million land-mines world-wide, causing thousands of casualties each month. Given the extent of the problem, a simple and cost-effective method of neutralizing land mines and other unexploded ordnance is urgently needed. For many operations, conventional explosives such as commercial explosives (dynamites and equivalent explosives such as slurries or emulsions); or military explosives such as Trinitrotoluene (TNT) and plastic explosives such as Composition C-4, are used to destroy land mines and unexploded ordnance. These explosives all suffer from a logistics drawback due to the increased costs associated with the transportation and storage of hazardous explosives.

Explosives which are relatively safe to handle, and which must be sensitized prior to detonation, have been described in the prior art. The use of glass bubbles (microspheres) to sensitize aliphatic nitroparaffins is well known. Eckels, in U.S. Pat. No. 3,797,392, issued in 1974, outlined a method for the reversible sensitization of nitromethane through the use of microspheres. Chandler, in U.S. Pat. No. 3,902,933 issued in 1975, taught the use of microspheres using an open celled polymeric foam containing about 15 to 85 percent by weight of the spheres. Subsequently, U.S. Pat. No. 3,977,921 issued in 1976, also by Chandler, teaches the use of an open-celled polymeric foam to sensitize nitromethane to detonation by a blasting cap. Hurst, in U.S. Pat. No. 3,926,119 issued in 1975, teaches the use of a container with chambers allowing passage of the liquid but not solid, where the solids can include solid oxide, microspheres and expanded silica. The liquid comprises nitroparaffins such as nitromethane. Forsythe, in U.S. Pat. No. 4,076,562 issued in 1978, teaches the use of microspheres adhered to the side of a container to sensitize nitromethane to a number 6 blasting cap. Kass, in U.S. Pat. No. 4,763,576 issued in 1988, teaches the use of layers of foam material with interstitial layers of microspheres to provide an energy transmittal device capable of detonating liquid nitromethane.

However, the prior art suffers from the disadvantage that it can be relatively time-consuming to assemble and measure the necessary ingredients and prepare the explosive combination at the locus of use. In addition, the explosive systems disclosed in the prior art can be relatively expensive to produce and transport.

SUMMARY OF THE INVENTION

Accordingly, it is an object of the present invention to provide an improved kit for humanitarian demining operations and explosive ordnance disposal which can be simply made using inexpensive materials.

It is a further object of this invention to provide an improved kit for humanitarian demining operations and explosive ordnance disposal which can be inexpensively stored and shipped as a low risk flammable liquid and inert substance, which can be combined quickly and easily at the locus of use to provide a powerful explosive.

It is a still further object of this invention to provide a relatively simple and inexpensive method for explosive neutralization of land mines and unexploded ordnance.

The above objects are achieved by providing a kit for humanitarian demining operations and explosive ordnance disposal comprising a first sealed container having an opening means; a premeasured amount of flammable nitroparaffin contained in said first sealed container; a second sealed container having a resealing means; a sensitizing means contained in said second sealed container which sensitizes the nitroparaffin to detonation using an initiation system; said second sealed container having a volume sufficient to contain both said sensitizing means and said premeasured amount of flammable nitroparaffin. In another aspect said kit also includes an initiation system.

Conveniently, said first sealed container is a commercially available or custom manufactured plastic bottle and said opening means is a screw top cap. In one aspect, said flammable nitroparaffin is selected from a group consisting of nitromethane, nitroethane, 1-nitropropane, 2-nitropropane, and mixtures thereof.

In one embodiment, said second sealed container is a re-sealable plastic bag selected from a group consisting of commercially available or custom manufactured re-sealable sandwich bags and re-sealable freezer bags. In another embodiment, said second sealed container is a commercially available plastic or custom manufactured container and said resealing means is an attachable lid or screw-top cap.

Conveniently, said pre-measured amount of flammable nitroparaffin is substantially 200 g or 400 g.

In one embodiment, said sensitizing means consists of an open-celled polymeric sponge or foam having a density of 1 to 32 kg/m$^3$. In another embodiment, said sensitizing means consists of a powdered solids blend of fumed silica and microspheres. While the applicant does not wish to be held to any one theory, it is believed that the sensitizing means described above beneficiates the explosion by providing localized density discontinuities, adiabatic reaction sites or "hot spots" to the flammable nitroparaffin.

Conveniently, said initiation system comprises an electrical, safety fuse or shock tube fired blasting cap of minimum #12 strength, or a detonating cord, or a combination thereof.

The present invention further provides a method of exploding land mines and unexploded ordnance which comprises;

providing a kit having a first sealed container having an opening means; a pre-measured amount of flammable nitroparaffin contained in said first sealed container; a second sealed container having a resealing means; a sensitizing means contained in said second sealed container which sensitizes the nitroparaffin to detonation using an initiation system; said second sealed container having a volume sufficient to contain both said sensitizing means and said pre-measured amount of flammable nitroparaffin; and an initiation system for detonating said flammable nitroparaffin; assembling said kit by transferring said flammable nitroparaffin from said first container into said second container;

resealing said second container;

affixing said initiation system to said second container;

placing said second container adjacent to a land mine or unexploded ordnance; and detonating said sensitized flammable nitroparaffin with said initiation system.

In another embodiment, this invention provides a kit for humanitarian demining operations and explosive ordnance disposal comprising:

a first container having an opening and closing means;

a pre-measured amount of a flammable nitroparaffin contained in said first container; a second container having an opening and closing means;

a pre-measured amount of a thickening agent for increasing the viscosity of said nitroparaffin contained in either of said first container or said second container, a pre-measured amount of a sensitizing means contained in said second container for sensitizing said nitroparaffin to detonation by an initiation system;

wherein the proportion of said thickening agent and said sensitizing means relative to said flammable nitroparaffin is sufficient to sensitize said nitroparaffin to detonation by an initiation system;

said second container having a volume sufficient to contain said flammable nitroparaffin, said thickening agent, and said sensitizing means.

Conveniently, the first and second container is a plastic bottle and the opening and closing means is a screw top cap. In one embodiment, the screw top cap of the second container has a means for connecting to an initiation system, such as a small hole adapted to receive a blasting cap or detonating cord.

Conveniently, the flammable nitroparaffin is selected from the group consisting of nitromethane, nitroethane, 1-nitropropane, 2-nitropropane, and mixtures thereof; the thickening agent is fumed silica; and the sensitizing means is selected from the group consisting of microspheres and finely powdered aluminum. In one embodiment, the first and second container each further contains a different coloured pigment.

In one variation, the flammable nitroparaffin is nitroethane;

the thickening agent is fumed silica; and the sensitizing agent is microspheres; and the relative proportions of nitroparaffin, thickening agent, and sensitizing agent are substantially 78 to 88 percent by weight of nitroparaffin, 0.5 to 5 percent by weight of thickening agent, and 10 to 15 percent by weight of sensitizing agent.

In another variation the flammable nitroparaffin is nitromethane;

the thickening agent is fumed silica; and the sensitizing agent is microspheres; and the relative proportions of nitroparaffin, thickening agent, and sensitizing agent are substantially 86 to 97.5 percent by weight of nitroparaffin, 0.5 to 15 percent by weight of thickening agent, and 0.5 to 5 percent by weight of sensitizing agent.

This invention further provides a method of exploding land mines and unexploded ordnance which comprises providing a kit having:

a first container having an opening and closing means;

a pre-measured amount of a flammable nitroparaffin contained in said first container;

a second container having an opening and closing means;

a pre-measured amount of a thickening agent for increasing the viscosity of said nitroparaffin contained in either of said first container or said second container, a pre-measured amount of a sensitizing means contained in said second container for sensitizing said nitroparaffin to detonation by an initiation system; wherein the proportion of said thickening agent and said sensitizing means relative to said flammable nitroparaffin is sufficient to sensitize said nitroparaffin to detonation by an initiation system; and wherein said second container has a volume sufficient to contain said flammable nitroparaffin, said thickening agent, and said sensitizing means;

and an initiation system for detonating said flammable nitroparaffin;

assembling said kit by shaking said first container and said second container;

transferring said flammable nitroparaffin from said first container into said second container;

closing said second container;

mixing the contents of said second container; and affixing said initiation system to said second container;

placing said assembled kit adjacent a land mine or unexploded ordnance, and detonating said flammable nitroparaffin with said initiation system.

An advantage of this invention is that the kit can be made simply and inexpensively using commercially available or custom manufactured materials. A further advantage is that the kit can be inexpensively stored and shipped as a low risk flammable liquid, and inert substance, and combined at the locus of use to provide a powerful explosive. For example, in North America the kit can be stored and shipped as a Class 3 Flammable Liquid and combined at the locus of use to create a Class 1 Explosive. The kit can be assembled quickly and easily by pouring the flammable nitroparaffin from the first container into the second container, resealing the second container, attaching the initiation system to the second container and placing the assembled kit adjacent to the land mine or unexploded ordnance. Given the simplicity of this method, it is relatively easy to train indigenous personnel in its use.

BRIEF DESCRIPTION OF THE DRAWINGS

A better understanding of the invention will be obtained by considering the detailed description below, with reference to the following drawings of embodiments of the present invention in which:

FIG. 7 illustrates the step of shaking the first and second containers prior to pouring the contents of the first container into the second container.

FIG. 8 illustrates the step of pouring the contents of the first container into the second container.

FIG. 9 illustrates the step of shaking the second container to mix the flammable nitroethane, fumed silica, microspheres, and pigments.

FIG. 10 illustrates the step of affixing a blasting cap to the second container by inserting the blasting cap through a hole in the screw top lid.

FIG. 11 illustrates the step of placing the assembled kit adjacent a land mine, prior to detonation.

DETAILED DESCRIPTION OF THE INVENTION

Figure 1:
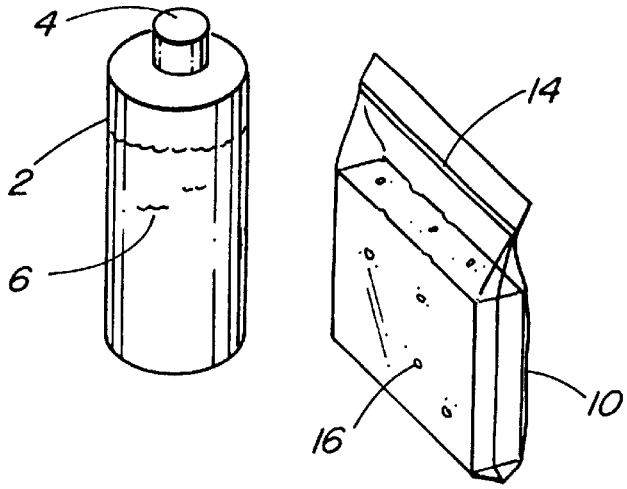
FIG. 1 is a side view of a first container and a second container, wherein the first container contains flammable nitroparaffin and the second container comprises a re-sealable plastic bag containing an open-celled polymeric sponge.

Referring to FIG. 1, a kit according to the present invention includes a first container (2) with an opening means (4), such as a screw-top cap. The first container (2) is filled with a pre-measured amount of flammable nitroparaffin (6), such as nitromethane. The kit also contains a second container (10) with a resealing means (14), such as a plastic zipper. In the embodiment shown in FIG. 1, the second container (10) is a re-sealable plastic bag. In this embodiment, the second container (10) contains an open-celled polymeric sponge (16), which is capable of sensitizing flammable nitroparaffin to detonation.

Figure 2:
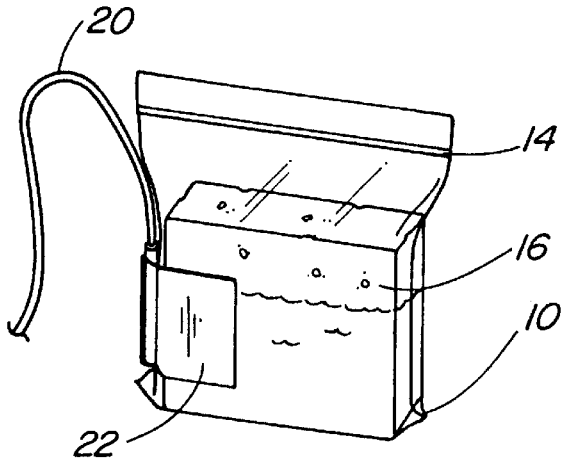
FIG. 2 is a side view of a combined kit, wherein the flammable nitroparaffin has been transferred to the second container, and a blasting cap has been affixed to the outside of the second container using adhesive tape.

FIG. 2 illustrates the embodiment of FIG. 1 in combined form. The flammable nitroparaffin (6) has been transferred from the first container (2) into the second container (10), and the resealing means (14) of the second container (10) has been resealed. An initiation system (20) has been affixed to the outside of the second container (10), using adhesive tape (22). In this embodiment, the initiation system (20) consists of an electric blasting cap of minimum #12 strength. However, it will be appreciated that other suitable initiation systems may be used, such as a 57 grain per foot detonating cord with a #8 knot in it, or a safety fuse or shock tube fired blasting cap of minimum #12 strength. If only lower strength detonators are available, then it is advisable to test the reliability of detonation before any deployment against ordnance.

Figure 3:
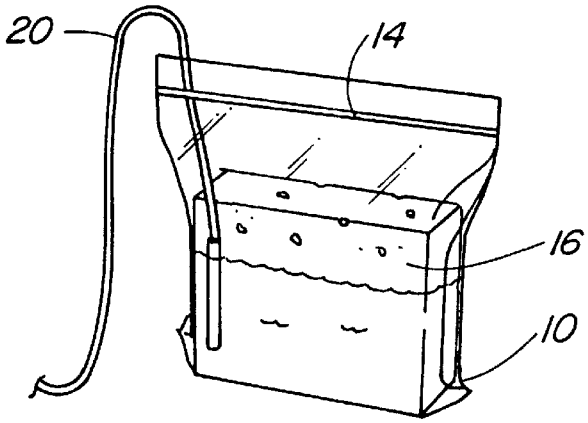
FIG. 3 is a side view of a combined kit, similar to FIG. 2, wherein a blasting cap has been inserted into the second container, through the Ziploc™ seal.

FIG. 3 illustrates another method of attaching the initiation system (20) to this embodiment, whereby the initiation system (20) has been inserted through the resealing means (14) of the second container (10) into the sensitized flammable nitroparaffin (6).

Figure 4:
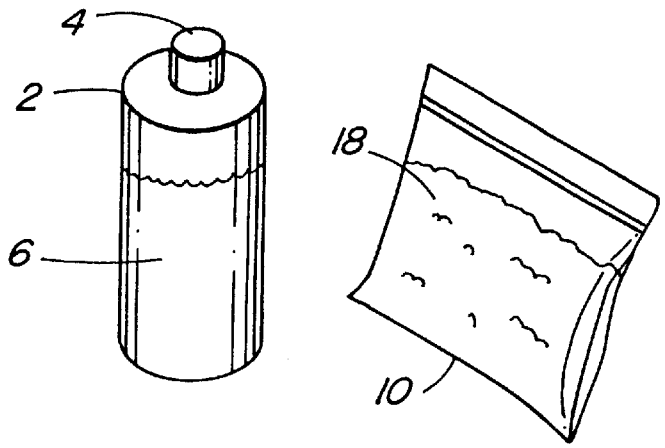
FIG. 4 is a side view of a first container and a second container, wherein the first container contains flammable nitroparaffin and the second container comprises a re-sealable plastic bag containing a blend of fumed silica and microspheres.

FIG. 4 illustrates another embodiment of the present invention, in which the second container (10) contains a powdered solids blend of fumed silica and glass microspheres (18), which is capable of sensitizing flammable nitroparaffin to detonation. In this embodiment, the powdered solids blend (18) consists of four percent by weight of fumed silica (Aerosilϕ-200) and one percent by weight of glass microspheres (3M Scotchlite™ Glass Bubbles).

However, it will be appreciated that the proportion of fumed silica and glass microspheres relative to nitroparaffin may be varied within a range capable of sensitizing the nitroparaffin to detonation by the initiation system. The required proportions will vary depending on the kind of nitroparaffin used. For example, with pure nitroethane, a range of 10 to 15 percent by weight of microspheres and 2 to 7 percent by weight of filmed silica have been found desirable. With pure nitromethane a range of 0.5 to 7 percent by weight of microspheres and 2 to 7 percent by weight of fumed silica have been found desirable. However, it will be appreciated that one may use any combination capable of sensitizing the nitroparaffin to detonation by the initiation system. As used herein, the term "percent by weight" is used in reference to the combined weight of the contents of the first and second containers.

Figure 5:
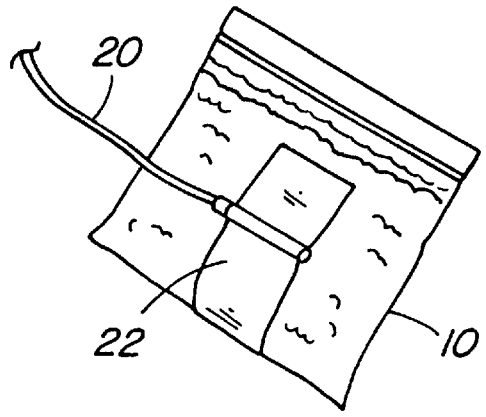
FIG. 5 is a side view of a combined kit, wherein the flammable nitroparaffin has been transferred to the second container, and a blasting cap has been affixed to the outside of the second container using adhesive tape.

FIG. 5 illustrates the embodiment of FIG. 4 in combined form. The flammable nitroparaffin (6) has been transferred from the first container (2) into the second container (10) and the resealing means (14) has been resealed. An initiation system (20) has been affixed to the outside of the second container (10) using adhesive tape (22). In this embodiment, the initiation system (20) consists of an electric blasting cap of minimum #8 strength.

Figure 6:
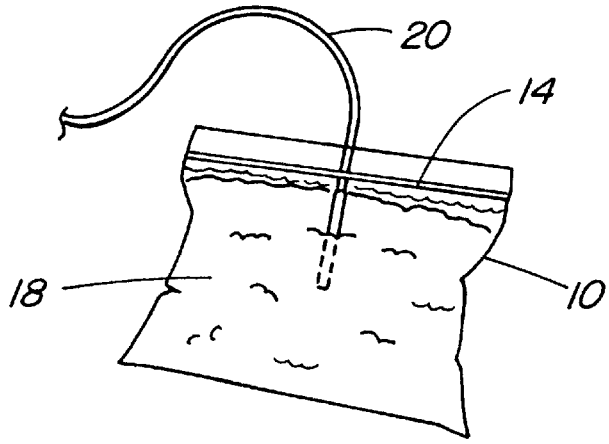
FIG. 6 is a side view of a combined kit, similar to FIG. 5, wherein a blasting cap has been inserted into the second container, through the Ziploc™ seal.

FIG. 6 illustrates another method of attaching the initiation system (20) to this embodiment, whereby the initiation system (20) has been inserted through the resealing means (14) of the second container (10) into the sensitized flammable nitroparaffin (6).

The use of the kit can now be discerned, with reference to the embodiments discussed above. The kit may be stored and transported in an unassembled form as a dangerous but stable system much the same as other highly flammable substances. The kit may then be quickly and easily assembled using the following method. First, the user transfers a pre-measured amount of flammable nitroparaffin (6) from the first container (2) into the second container (10) and re-seals the resealing means (14). If using the embodiment wherein the second container (10) contains a powdered solids blend (18), the user then mixes the components by manual manipulation of the second container (10). Secondly, the user attaches an initiation system (20) to the second container (10), for example, by affixing it to the outside of the second container (10) using adhesive tape (22) or inserting it through the re-sealing means (14) of the second container (10) into the flammable nitroparaffin (6). The assembled kit is then placed adjacent a land mine or unexploded ordnance, and the initiation system (20) is activated to detonate the sensitized flammable nitroparaffin (6) in the second container (10). The resulting explosive typically has a velocity of 3500 to 5800 meters per second, which is sufficient to explode the land mine or other unexploded ordnance. Multiple assembled kits may be used where a greater force is required.

FIGS. 7 to 11 illustrate another embodiment of the present invention in which the first container (2) and the second container (10) are plastic bottles with screw top caps (4 and 14, respectively). The screw top cap (14) of the second container (10) has a small hole for connection to the initiation system (20). In the illustrated embodiment, the plastic bottles were custom manufactured to have a capacity of 500 mL, and dimensions of 76×57×152 mL. However, it will be appreciated that other sizes of plastic bottles may be used, with appropriate adjustments. The first container (2) contains 86 percent by weight of flammable nitroethane, 3 percent by weight of fumed silica, and 0.05 percent by weight of red pigment, which is an internationally recognized colour for labeling flammable liquids. The second container (10) contains 11 percent by weight of microspheres, and 0.1 percent by weight of orange pigment. In a variation of this embodiment, the fumed silica may be housed in the second container (10), instead of the first container (2).

Figure 7:
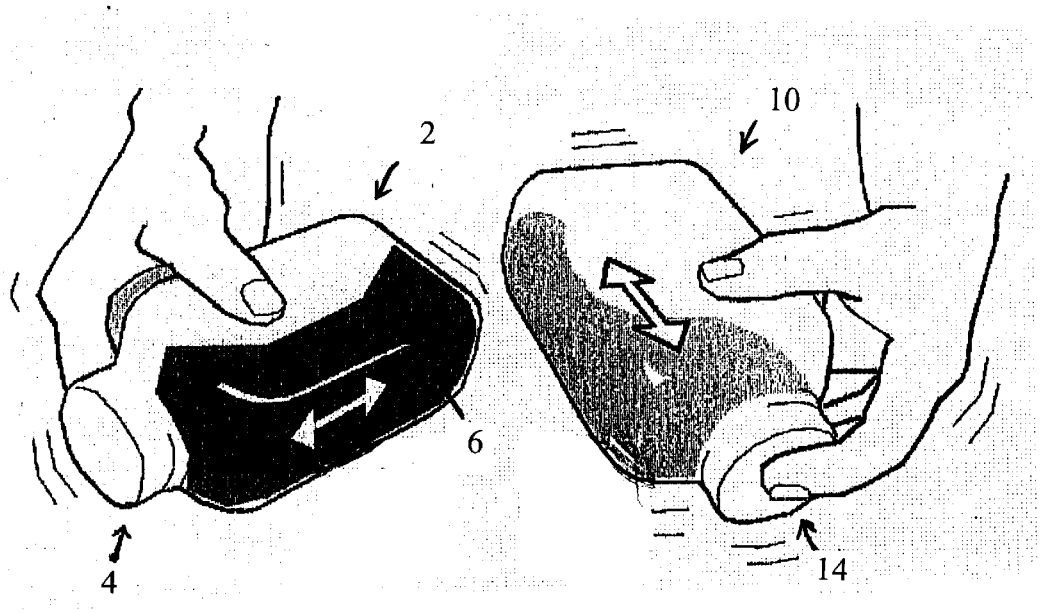
FIGS. 7 to 11 are perspective views of another embodiment of the present invention, wherein the first and second containers are plastic bottles with screw top caps, and wherein the first container contains flammable nitroethane, fumed silica, and a small quantity of red pigment, and the second container contains microspheres and a small quantity of orange pigment.
Figure 8:
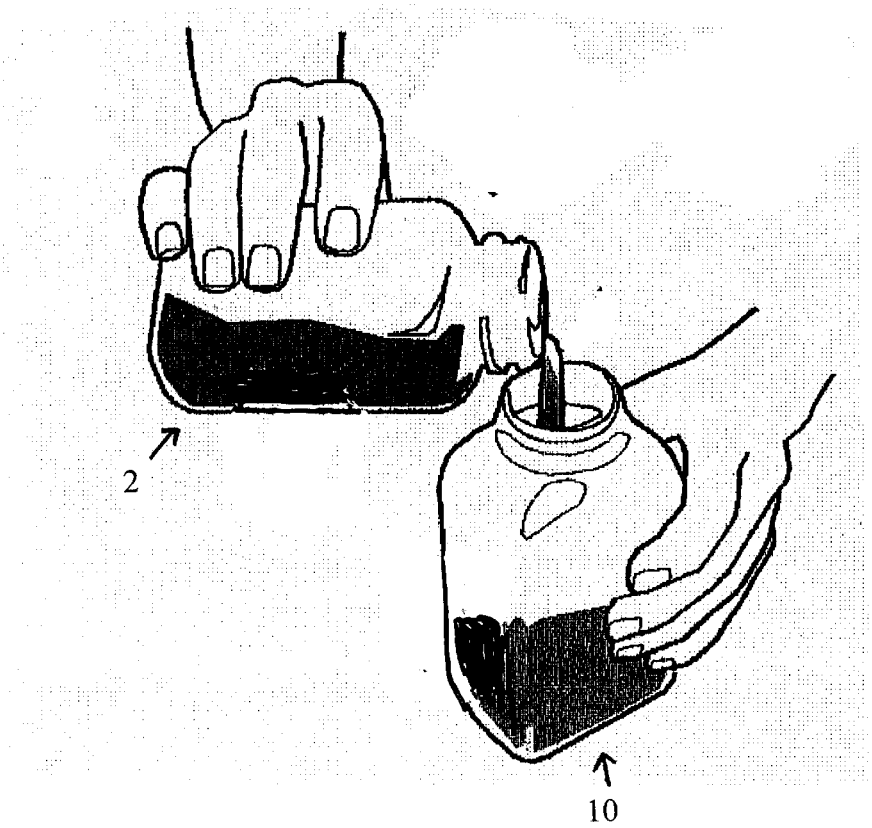
Figure 9:
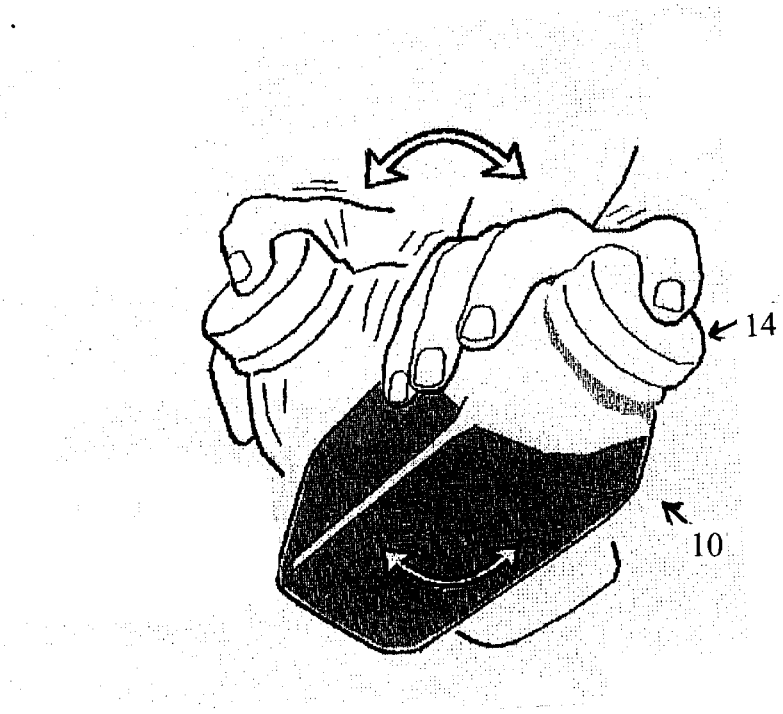

In use, the first container (2) and second container (10) are shaken, as illustrated in FIG. 7, before pouring the contents of the first container (2) into the second container (10), as illustrated in FIG. 8. The screw top cap (14) is screwed back onto the second container (10), and the second container (10) is shaken to combine its contents, as illustrated in FIG. 9. It will be noted that the pigmentation of the combined contents turns a bright orange colour, which is an internationally recognized colour for labeling of explosives material. Thus, it will be seen that the addition of the appropriate colour and quantity of pigment to the contents of the first and second containers is a simple and novel method of signaling the character of the flammable liquid, and the explosive combination. It also serves the additional purpose of aiding the user in determining when the contents of the second container are sufficiently mixed.

Figure 10:
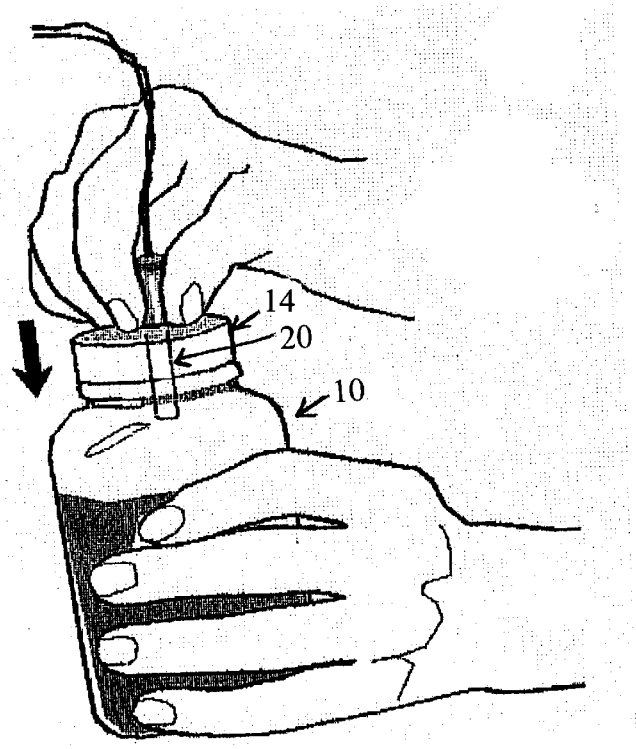
Figure 11:
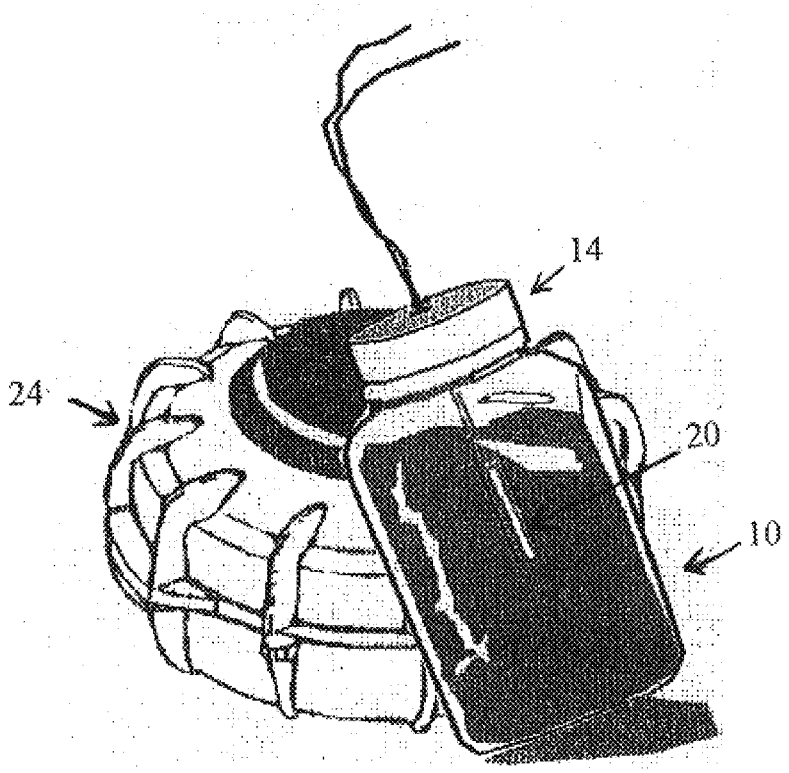

An initiation system (20), such as an electric blasting cap of #12 strength, is then inserted through the hole in the screw top cap (14) of the second container (10), as illustrated in FIG. 10. The assembled kit may then be placed adjacent a land mine or unexploded ordnance (24), as illustrated in FIG. 11.

Figure 12:
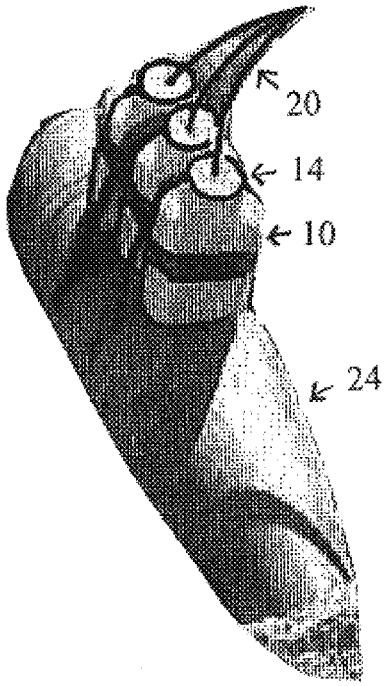
FIG. 12 illustrates the use of three assembled kits to detonate an unexploded ordnance.

Multiple assembled kits may be used when it is necessary to generate a greater explosive force, as illustrated in FIG. 12. When using multiple assembled kits it is recommended that they be detonated simultaneously using a single detonator. To increase explosive force, it is also recommended that the containers (10) be placed in a substantially upright position with the base of the container sitting on the unexploded ordnance (24), as illustrated in FIG. 12. Or pointing toward the unexploded ordnance. Although the inventor does not wish to be tied to any one theory, it is believed that this positioning causes the explosion to be propagated through the flammable nitroparaffin and focuses the explosive force. This has been termed the Munroe effect.

It will be appreciated that most of the components of the present invention consist of inexpensive, commercially available products. In one embodiment, the first container (2) is a commercially available, plastic container with a screw-top cap. Similarly, the second container (10) with resealing means (14) may be a plastic container with a screw-top cap, or a re-sealable plastic bag, such as a GLAD™ Zipper Sandwich Bag. In another embodiment, the second container (10) with resealing means (14) is a plastic container with an attachable lid, such as a Rubbermaid™, Tupperware™, FRIG-O-SEAL™, or other plastic, storage-type container. In one embodiment, the means for sensitizing flammable nitroparaffin is an open-celled polymeric sponge (16), such as a Sponge-Its™ house-hold sponge. In an alternative embodiment, custom manufactured containers may be substituted for the commercially available containers (2) and (10).

Four examples of the utility of these units are provided:

EXAMPLE 1

In this example, 500 g of nitromethane was added to the re-sealable plastic bag containing the open-celled polymeric foam sponge. The bag was resealed and the blasting cap attached to the side in the manner shown in FIG. 2. This assembled kit was placed against the side of a surface-laid, typical unfused anti-tank mine which contains approximately 10 kg of the explosive Composition B. Detonation of the assembled kit resulted in sympathetic detonation of the anti-tank mine as evidenced by the large crater generated by the blast of the mine.

EXAMPLE 2

In this example, 500 g of nitromethane was added to the re-sealable plastic bag containing the open-celled polymeric foam sponge. The bag was resealed and the blasting cap attached to the side in the manner shown in FIG. 3. This assembled kit was placed against the side of a surface-laid, typical unfused anti-tank mine which contains approximately 9 kg of the explosive Trinitrotoluene (TNT). Detonation of the assembled kit resulted in sympathetic detonation of the anti-tank mine as evidenced by the large crater generated by the blast of the mine.

EXAMPLE 3

In this example, 500 g of nitromethane was added to the re-sealable plastic bag containing a blend of 4 percent by weight of fumed silica and 1 percent by weight of glass microspheres. The bag was resealed, the component mixed by manual manipulation of the bag, and the blasting cap attached to the side in the manner shown in FIG. 5. This assembled kit was placed against the side of a surface-laid, typical unfused anti-tank mine which contains approximately 9 kg of the explosive Trinitrotoluene (TNT). Detonation of the assembled kit resulted in sympathetic detonation of the anti-tank mine as evidenced by the large crater generated by the blast of the mine.

EXAMPLE 4

In this example, three assembled kits were detonated simultaneously to create a sympathetic detonation of an unfused 155 mm HE Artillery Round. Each kit consisted of two plastic containers with screw top caps, and a capacity of 500 mL. The first container of each kit contained 86 percent by weight of nitroethane, 3 percent by weight of fumed silica, and 0.05 percent by weight of red pigment, while the second container of each kit contained 11 percent by weight of glass microspheres and 0.1 percent by weight of orange pigment. The containers were shaken before adding the contents of the first container to the second container. A screw top cap having a hole for receiving an initiation system was then screwed onto the second container of each kit, and the second containers were shaken to mix the contents. A 57 grain per foot detonating cord with a #8 knot in it was then inserted through the hole in the screw top caps of each of the three second containers. The three assembled kits were affixed to the Artillery Round with adhesive tape, so that the containers were in a substantially upright position with their bases resting against the Artillery Round. The ends of the three detonating cords were then brought together so that all three could be initiated simultaneously using one detonator. Simultaneous detonation of the assembled kits resulted in sympathetic detonation of the Artillery Round.

A person understanding this invention may now conceive of alternative structures and embodiments or variations of the above, all of which are intended to fall within the scope of the invention as defined in the claims that follow.

I claim:

1. A kit for humanitarian demining operations and explosive ordnance disposal comprising:

a first sealable container having an opening means;

a pre-measured amount of liquid flammable nitroparaffin contained in said first sealable container and pourable therefrom;

a second sealable container having a resealing means;

a pre-determined amount of a sensitizing means contained in said second sealable container sufficient to sensitize the nitroparaffin to detonation using an initiation system;

said second sealable container having a volume sufficient to contain both said sensitizing means and said pre-measured amount of flammable nitroparaffin, whereby said nitroparaffin may be added to said sensitizing means to form an explosive, and said sensitizing means consists of a powdered solids blend of fumed silica and microspheres.

2. A kit for humanitarian demining operations and explosive ordnance disposal comprising:

a first sealable container having an opening means;

a pre-measured amount of liquid flammable nitroparaffin contained in said first sealable container and pourable therefrom;

a second sealable container having a resealing means;

a pre-determined amount of a sensitizing means contained in said second sealable container sufficient to sensitize the nitroparaffin to detonation using an initiation system;

said second sealable container having a volume sufficient to contain both said sensitizing means and said pre-measured amount of flammable nitroparaffin, whereby said nitroparaffin may be added to said sensitizing means to form an explosive, and said sensitizing means consists of a powdered solids blend of fumed silica and microspheres, wherein the proportion of said fumed silica and said microspheres relative to said flammable nitroparaffin is sufficient to sensitize said nitroparaffin to detonation by an initiation system.

3. A kit for humanitarian demining operations and explosive ordnance disposal comprising:

a first sealable container having an opening means;

a pre-measured amount of liquid flammable nitroparaffin contained in said first sealable container and pourable therefrom;

a second sealable container having a resealing means;

a pre-determined amount of a sensitizing means contained in said second sealable container sufficient to sensitize the nitroparaffin to detonation using an initiation system;

said second sealable container having a volume sufficient to contain both said sensitizing means and said pre-measured amount of flammable nitroparaffin, whereby said nitroparaffin may be added to said sensitizing means to form an explosive, and said sensitizing means consists of a powdered solids blend of fumed silica and microspheres, wherein said flammable nitroparaffin is nitroethane and wherein the relative proportions of nitroethane, fumed silica, and microspheres are substantially 78 to 88 percent by weight of nitroethane, 10 to 15 percent by weight of microspheres, and 2 to 7 percent by weight of fumed silica.

4. A kit for humanitarian demining operations and explosive ordnance disposal comprising:

a first sealable container having an opening means;

a pre-measured amount of liquid flammable nitroparaffin contained in said first sealable container and pourable therefrom;

a second sealable container having a resealing means;

a pre-determined amount of a sensitizing means contained in said second sealable container sufficient to sensitize the nitroparaffin to detonation using an initiation system;

said second sealable container having a volume sufficient to contain both said sensitizing means and said pre-measured amount of flammable nitroparaffin, whereby said nitroparaffin may be added to said sensitizing means to form an explosive, and said sensitizing means consists of a powdered solids blend of fumed silica and microspheres, wherein said flammable nitroparaffin is nitromethane and wherein the relative proportions of nitromethane, fumed silica, and microspheres are substantially 86 to 97.5 percent by weight of nitromethane, 0.5 to 7 percent by weight of microspheres, and 2 to 7 percent by weight of fumed silica.

5. A method of exploding land mines and unexploded ordnance which comprises providing a kit having:

a first sealable container having an opening means;

a pre-measured amount of liquid flammable nitroparaffin contained in said first sealable container and pourable therefrom, a second sealable container having a resealing means;

a pre-determined amount of a sensitizing means contained in said second sealable container sufficient to sensitize the nitroparaffin to detonation using an initiation system;

said second sealable container having a volume sufficient to contain both said sensitizing means and said pre-measured amount of flammable nitroparaffin, whereby said nitroparaffin may be added to said sensitizing means to form an explosive, and an initiation system for detonating said flammable nitroparaffin;

assembling said kit by transferring said flammable nitroparaffin from said first container into said second container;

affixing said initiation system to said second container;

and resealing said second container;

placing said second container adjacent a land mine or unexploded ordnance; and detonating said flammable nitroparaffin with said initiation system, wherein said second sealable container is a resealable plastic bag.

6. A method of exploding land mines and unexploded ordnance which comprises providing a kit having:

a first sealable container having an opening means;

a pre-measured amount of liquid flammable nitroparaffin contained in said first sealable container and pourable therefrom, a second sealable container having a resealing means;

a pre-determined amount of a sensitizing means contained in said second sealable container sufficient to sensitize the nitroparaffin to detonation using an initiation system;

said second sealable container having a volume sufficient to contain both said sensitizing means and said pre-measured amount of flammable nitroparaffin, whereby said nitroparaffin may be added to said sensitizing means to form an explosive, and an initiation system for detonating said flammable nitroparaffin;

assembling said kit by transferring said flammable nitroparaffin from said first container into said second container;

affixing said initiation system to said second container;

and resealing said second container;

placing said second container adjacent a land mine or unexploded ordnance; and detonating said flammable nitroparaffin with said initiation system, and said sensitizing means consists of a powdered solids blend of fumed silica and microspheres.

7. A method of exploding land mines and unexploded ordnance which comprises providing a kit having:

a first sealable container having an opening means;

a pre-measured amount of liquid flammable nitroparaffin contained in said first sealable container and pourable therefrom, a second sealable container having a resealing means;

a pre-determined amount of a sensitizing means contained in said second sealable container sufficient to sensitize the nitroparaffin to detonation using an initiation system;

said second sealable container having a volume sufficient to contain both said sensitizing means and said pre-measured amount of flammable nitroparaffin, whereby said nitroparaffin may be added to said sensitizing means to form an explosive, and an initiation system for detonating said flammable nitroparaffin;

assembling said kit by transferring said flammable nitroparaffin from said first container into said second container;

affixing said initiation system to said second container;

and resealing said second container;

placing said second container adjacent a land mine or unexploded ordnance; and detonating said flammable nitroparaffin with said initiation system, and said sensitizing means consists of a powdered solids blend of fumed silica and microspheres, wherein the proportion of said fumed silica and said microspheres relative to said flammable nitroparaffin is sufficient to sensitize said nitroparaffin to detonation by an initiation system.

8. A method of exploding land mines and unexploded ordnance which comprises providing a kit having:

a first sealable container having an opening means;

a pre-measured amount of liquid flammable nitroparaffin contained in said first sealable container and pourable therefrom, a second sealable container having a resealing means;

a pre-determined amount of a sensitizing means contained in said second sealable container sufficient to sensitize the nitroparaffin to detonation using an initiation system;

said second sealable container having a volume sufficient to contain both said sensitizing means and said pre-measured amount of flammable nitroparaffin, whereby said nitroparaffin may be added to said sensitizing means to form an explosive, and an initiation system for detonating said flammable nitroparaffin;

assembling said kit by transferring said flammable nitroparaffin from said first container into said second container;

affixing said initiation system to said second container;

and resealing said second container;

placing said second container adjacent a land mine or unexploded ordnance; and detonating said flammable nitroparaffin with said initiation system, and said sensitizing means consists of a powdered solids blend of fumed silica and microspheres, wherein said flammable nitroparaffin is nitroethane and wherein the relative proportions of nitroethane, flumed silica, and microspheres are substantially 78 to 88 percent by weight of nitroethane, 10 to 15 percent by weight of microspheres, and 2 to 7 percent by weight of fumed silica.

9. A method of exploding land mines and unexploded ordnance which comprises providing a kit having:

a first sealable container having an opening means;

a pre-measured amount of liquid flammable nitroparaffin contained in said first sealable container and pourable therefrom, a second sealable container having a resealing means;

a pre-determined amount of a sensitizing means contained in said second sealable container sufficient to sensitize the nitroparaffin to detonation using an initiation system;

said second sealable container having a volume sufficient to contain both said sensitizing means and said pre-measured amount of flammable nitroparaffin, whereby said nitroparaffin may be added to said sensitizing means to form an explosive, and an initiation system for detonating said flammable nitroparaffin;

assembling said kit by transferring said flammable nitroparaffin from said first container into said second container;

affixing said initiation system to said second container;

and resealing said second container;

placing said second container adjacent a land mine or unexploded ordnance; and detonating said flammable nitroparaffin with said initiation system, and said sensitizing means consists of a powdered solids blend of fumed silica and microspheres, wherein said flammable nitroparaffin is nitromethane and wherein the relative proportions of nitromethane, fumed silica, and microspheres are substantially 86 to 97.5 percent by weight of nitromethane, 0.5 to 7 percent by weight of microspheres, and 2 to 7 percent by weight of fumed silica.

10. A kit for humanitarian demining operations and explosive ordnance disposal comprising:

a first container having an opening and closing means;

a pre-measured amount of a flammable nitroparaffin contained in said first container;

a second container having an opening and closing means;

a pre-measured amount of a thickening agent for increasing the viscosity of said nitroparaffin contained in either of said first container or said second container;

a pre-measured amount of a sensitizing means contained in said second container for sensitizing said nitroparaffin to detonation by an initiation system;

wherein the proportion of said thickening agent and said sensitizing means relative to said flammable nitroparaffin is sufficient to sensitize said nitroparaffin to detonation by an initiation system;

said second container having a volume sufficient to contain said flammable nitroparaffin, said thickening agent, and said sensitizing means; and said first and second container are plastic bottles and said opening and closing means are screw top caps.

11. A kit for humanitarian demining operations and explosive ordnance disposal comprising:

a first container having an opening and closing means;

a pre-measured amount of a flammable nitroparaffin contained in said first container;

a second container having an opening and closing means;

a pre-measured amount of a thickening agent for increasing the viscosity of said nitroparaffin contained in either of said first container or said second container;

a pre-measured amount of a sensitizing means contained in said second container for sensitizing said nitroparaffin to detonation by an initiation system;

wherein the proportion of said thickening agent and said sensitizing means relative to said flammable nitroparaffin is sufficient to sensitize said nitroparaffin to detonation by an initiation system;

said second container having a volume sufficient to contain said flammable nitroparaffin, said thickening agent, and said sensitizing means; and said first and second container are plastic bottles and said opening and closing means are screw top caps, wherein said means for connecting to an initiation system consists of a small hole adapted to receive a blasting cap or detonating cord.

12. A kit for humanitarian demining operations and explosive ordnance disposal comprising:

a first container having an opening and closing means;

a pre-measured amount of a flammable nitroparaffin contained in said first container;

a second container having an opening and closing means;

a pre-measured amount of a thickening agent for increasing the viscosity of said nitroparaffin contained in either of said first container or said second container;

a pre-measured amount of a sensitizing means contained in said second container for sensitizing said nitroparaffin to detonation by an initiation system;

wherein the proportion of said thickening agent and said sensitizing means relative to said flammable nitroparaffin is sufficient to sensitize said nitroparaffin to detonation by an initiation system;

said second container having a volume sufficient to contain said flammable nitroparaffin, said thickening agent, and said sensitizing means; and said first and second container are plastic bottles and said opening and closing means are screw top caps, wherein said sensitizing means is selected from the group consisting of microspheres and finely powdered aluminum.

13. A kit for humanitarian demining operations and explosive ordnance disposal comprising:

a first container having an opening and closing means;

a pre-measured amount of a flammable nitroparaffin contained in said first container;

a second container having an opening and closing means;

a pre-measured amount of a thickening agent for increasing the viscosity of said nitroparaffin contained in either of said first container or said second container;

a pre-measured amount of a sensitizing means contained in said second container for sensitizing said nitroparaffin to detonation by an initiation system;

wherein the proportion of said thickening agent and said sensitizing means relative to said flammable nitroparaffin is sufficient to sensitize said nitroparaffin to detonation by an initiation system;

said second container having a volume sufficient to contain said flammable nitroparaffin, said thickening agent, and said sensitizing means; and said first and second container are plastic bottles and said opening and closing means are screw top caps, wherein said first container and said second container each further contain a different coloured pigment.

14. A kit for humanitarian demining operations and explosive ordnance disposal comprising:

a first container having an opening and closing means;

a pre-measured amount of a flammable nitroparaffin contained in said first container;

a second container having an opening and closing means;

a pre-measured amount of a thickening agent for increasing the viscosity of said nitroparaffin contained in either of said first container or said second container;

a pre-measured amount of a sensitizing means contained in said second container for sensitizing said nitroparaffin to detonation by an initiation system;

wherein the proportion of said thickening agent and said sensitizing means relative to said flammable nitroparaffin is sufficient to sensitize said nitroparaffin to detonation by an initiation system;

said second container having a volume sufficient to contain said flammable nitroparaffin, said thickening agent, and said sensitizing means; and said first and second container are plastic bottles and said opening and closing means are screw top caps, wherein said first container and said second container each further contain a different coloured pigment, wherein the pigment contained in said first container is red, and the pigment contained in said second container is orange; and wherein the contents of the first container and second container turn bright orange upon mixing.

15. A kit for humanitarian demining operations and explosive ordnance disposal comprising:

a first container having an opening and closing means;

a pre-measured amount of a flammable nitroparaffin contained in said first container;

a second container having an opening and closing means;

a pre-measured amount of a thickening agent for increasing the viscosity of said nitroparaffin contained in either of said first container or said second container;

a pre-measured amount of a sensitizing means contained in said second container for sensitizing said nitroparaffin to detonation by an initiation system;

wherein the proportion of said thickening agent and said sensitizing means relative to said flammable nitroparaffin is sufficient to sensitize said nitroparaffin to detonation by an initiation system;

said second container having a volume sufficient to contain said flammable nitroparaffin, said thickening agent, and said sensitizing means; and the flammable nitroparaffin is nitroethane;

the thickening agent is fumed silica; and the sensitizing agent consists of microspheres; and wherein the relative proportions of nitroparaffin, thickening agent, and sensitizing agent are substantially 78 to 88 percent by weight of nitroparaffin, 10 to 15 percent by weight of sensitizing agent, and 2 to 7 percent by weight of thickening agent.

16. A kit for humanitarian demining operations and explosive ordnance disposal comprising:

a first container having an opening and closing means;

a pre-measured amount of a flammable nitroparaffin contained in said first container;

a second container having an opening and closing means;

a pre-measured amount of a thickening agent for increasing the viscosity of said nitroparaffin contained in either of said first container or said second container;

a pre-measured amount of a sensitizing means contained in said second container for sensitizing said nitroparaffin to detonation by an initiation system;

wherein the proportion of said thickening agent and said sensitizing means relative to said flammable nitroparaffin is sufficient to sensitize said nitroparaffin to detonation by an initiation system;

said second container having a volume sufficient to contain said flammable nitroparaffin, said thickening agent, and said sensitizing means; and the flammable nitroparaffin is nitromethane;

the thickening agent is fumed silica; and the sensitizing agent consists of microspheres; and wherein the relative proportions of nitroparaffin, thickening agent, and sensitizing agent are substantially 86to 897.5 percent by weight of nitroparaffin, 0.5 to 7 percent by weight of sensitizing agent, and 2 to 7 percent by weight of thickening agent.

* * * * *

UNITED STATES PATENT AND TRADEMARK OFFICE

CERTIFICATE OF CORRECTION

PATENT NO. : 6,405,627 B1
DATED : June 18, 2002
INVENTOR(S) : C. John Anderson

It is certified that error appears in the above-identified patent and that said Letters Patent is hereby corrected as shown below:

Title page, Item [54] and Column 1, line 1,
In the title, change "ORDINANCE" to read -- ORDNANCE --

Column 16,
Line 19, delete "897.5" and insert -- 97.5 --

Signed and Sealed this

Twenty-fifth Day of March, 2003

JAMES E. ROGAN
*Director of the United States Patent and Trademark Office*